United States Patent [19]

Cronin

[11] 3,954,084

[45] May 4, 1976

[54] COUNTER-ROTATING MARINE PROPULSION SYSTEM

[76] Inventor: Francis J. Cronin, 34 Jackson Ave., Wayne, N.J. 07470

[22] Filed: Dec. 23, 1974

[21] Appl. No.: 535,970

[52] U.S. Cl. ..... 115/50; 416/87

[51] Int. Cl.[2] ..... B63H 1/04

[58] Field of Search ..... 115/37, 49–54, 115/23, 31; 114/147; 416/87, 108–109, 112, 116

[56] References Cited

UNITED STATES PATENTS

| | | | |
|---|---|---|---|
| 392,346 | 11/1888 | Kirsch | 115/52 |
| 515,883 | 3/1894 | Pelletier | 115/49 |
| 881,537 | 3/1908 | Betaany | 115/52 |

FOREIGN PATENTS OR APPLICATIONS

| | | | |
|---|---|---|---|
| 420,841 | 11/1925 | Germany | 115/52 |
| 730,757 | 8/1932 | France | 115/49 |
| 581,484 | 11/1924 | France | 115/50 |
| 13,512 | 9/1888 | United Kingdom | 115/52 |

*Primary Examiner*—Trygve M. Blix
*Assistant Examiner*—Jesus D. Sotelo
*Attorney, Agent, or Firm*—Silverman and Jackson

[57] ABSTRACT

A counter-rotating marine propulsion system employing a unique cam assembly which facilitates the alternate extension and retraction of a plurality of drive blades from a pair of counter-rotating spinwheels. The purpose of the retraction of the blades is to eliminate water drag which would otherwise be experienced by the blades as they traverse the inner area of the shroud of the spinwheel.

10 Claims, 9 Drawing Figures

COUNTER-ROTATING MARINE PROPULSION SYSTEM

BACKGROUND OF THE INVENTION

The present invention relates to counter-rotating means for marine vehicles. Representative examples of the art in this area appear in U.S. Pat. Nos. to Kirsch 155,192 (1874), Baker, 480,225 (1892), and Miller 2,777,414 (1957).

Most patents in this field relate primarily to paddle wheel vessels which, for the most part, have not been commercially viable for over fifty years. Their main relevancy to the present invention lies in their suggestion of a dual counter-rotating propeller mechanism.

The present invention moves beyond the above-mentioned counter-rotating feature in that it provides as its counter-rotating element a pair or gang of spinwheels having a plurality of blades which, by virtue of a novel camming arrangement, are extended and retracted in a manner which sharply reduces the dead-water drag upon the dual counter-rotating elements.

The prior art with regard to a reciprocating paddle arrangement includes U.S. Pat. Nos. to May, 22,884 (1859); Burger, 678,938 (1901); and Ferraguto, 1,869,136 (1932).

The weakness in the paddle retraction systems disclosed in these said patents lies in their functional complexity and lack of durability.

Accordingly, the present invention may be viewed as a means for providing an improved camming system that would enable such prior art as has been above enumerated to fulfill much of the technical promise which it, at one time, had enjoyed.

SUMMARY OF THE INVENTION

It is an object of the present invention to provide a counter-rotating marine propulsion system capable of high efficiency and performance.

It is another object of the present invention to provide an improved camming assembly for the blade sub-system of the spinwheel of such counter-rotating marine propulsion system.

It is a further object to provide a marine propulsion system which will obviate the need for a transmission or clutch assembly.

Also, it is an object of the present invention to reduce to workable terms a generalized theoretical approach to marine propulsion which has not heretofore been sufficiently refined in order to render it technically and commercially usable.

DETAILED DESCRIPTION OF THE INVENTION

Presented herein is a dual counter-rotating marine propulsion system, horizontally disposed with relationship to the bottom of a boat or ship, having inherent capabilities for speed and steering control. This system can be incorporated or miniaturized for adaptation into outboard motors as well as into light-heavyweight marine motors for use in association with a wide spectrum of different sized vessels.

Figure 1:
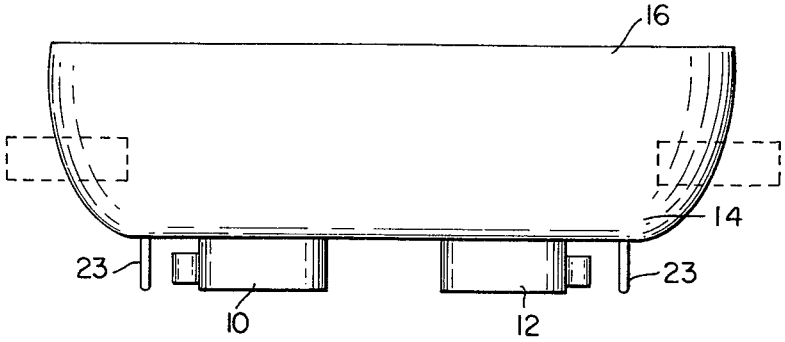
FIG. 1 is a front external view of a ship equipped with the present dual counter-rotating system.

Shown in FIG. 1 is a front external view of one embodiment of the present dual counter-rotating system. In this embodiment, a pair of counter-rotating spinwheels 10 and 12 are disposed against a bottom 14 of a marine craft 16. This counter-rotating motion is indicated by the respective arrows *w*+ and *w*− in FIG. 3.

As an alternative to this arrangement, the spinwheels 10 may be laterally disposed within the vessel 16 as is indicated by the dotted lines in FIG. 1.

Figure 3:
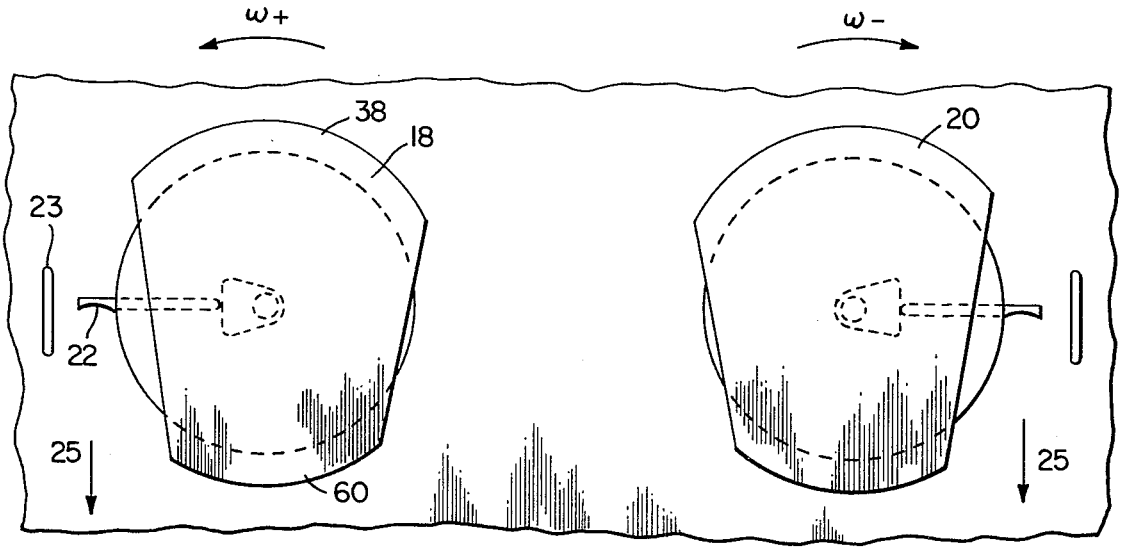
FIG. 3 is a bottom, external, schematic system view of the present invention.

A desired water pressure relative to blades 22 and parallel to the keel of the boat is obtained through the use of fixed shrouds 18 and 20 which partially surround the front and back of each spinwheel as is shown in FIG. 3. A parallel water pressure is further assured through the presence of deflectors 23 which help to direct the water in the direction indicated by arrows 25.

In this embodiment, steering control of the vessel is obtained through the use of conventional rudder means. However, as an alternative to this embodiment, directional control may be achieved through the positioning or rotating of the shrouds 18 and 20. However, at present, the use of movable shrouds is not anticipated.

The advantages which derive from the use of the present system include the possibility of operation in very shallow water, protection against fouling, and safety to persons in the water in that the shrouding system, the deflectors and the hereinafter described blade retraction sub-system lessens the possibility of contact with a swimmer.

Figure 2:
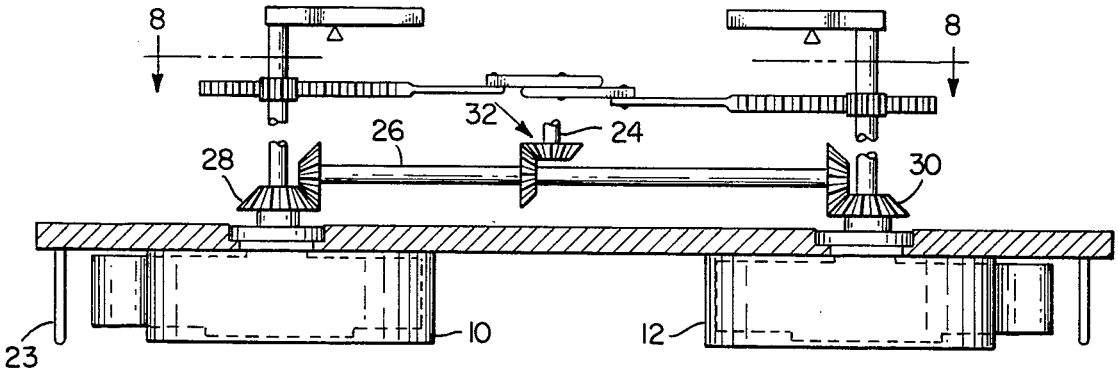
FIG. 2 is a front, cross-sectional, schematic view of the present invention.

Illustrated in FIG. 2 is a general schematic view of the present counter-rotating system in which a drive shaft 24 is to be taken as representative of any drive means, whether reciprocating, rotary, diesel, jet or steam powered in origin. Accordingly, the present system can be applied to any boat, ship, raft, float, submersible, or inflatable vessel. Thus, the present concept is applicable to various emergency type rafts or boats.

Referring again to FIG. 2, it is noted that the drive shaft 24 is geared into a transverse power shaft 26 which in turn serves as the drive means for a pair of spinwheel drive gears 28 and 30. It is to be noted that equivalent, or alternative, elements for the shaft 26 could include a variety of belt or gearing arrangements. As an optional feature, a clutch can be installed at area 32 in order to permit additional interfacing opportunities between the drive shaft and the spinwheels 10 and 12.

If desired, each spinwheel can be driven by separate engines having synchronized speeds.

Also, a suspension system can be incorporated into the propulsion assembly in order to tilt or rock the present system as the bow lifts in response to increased speed, thus maintaining the thrust or propulsion of the spinwheels at a substantially horizontal plane, e.g., minus fifteen (15°) to horizontal.

Figure 4:
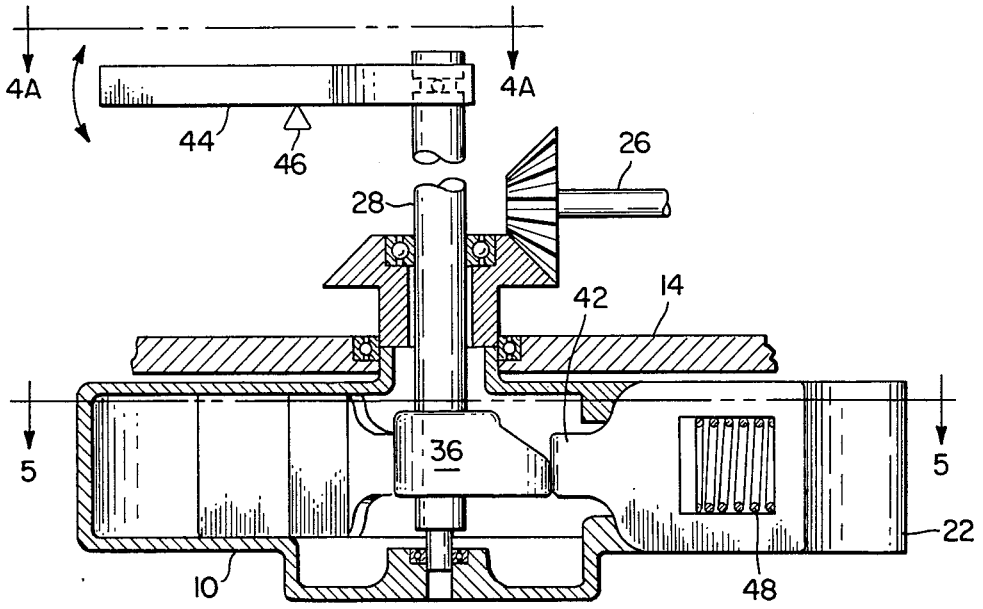
FIG. 4 is a detailed front cross-sectional view of one spinwheel, said view having a partial breakaway view therein of the blade-control sub-system.
Figure 5:
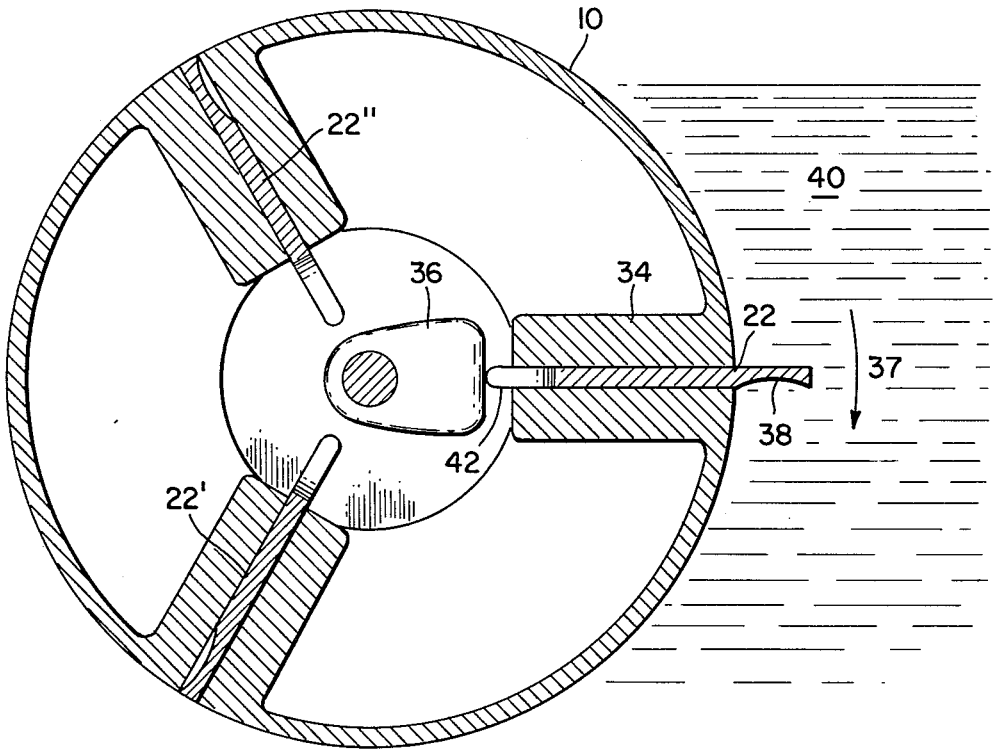
FIG. 5 is a top cross-sectional detailed view of the cam and blade sub-systems, taken along lines 5—5 of FIG. 4.
Figure 6:
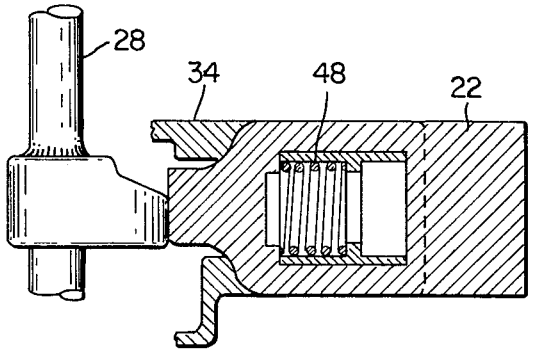
FIG. 6 is a detailed side view of the cam, spring and blade interaction of the cam sub-system of the spinwheel, showing the blade in an extended position.

Turning now to FIG. 4, there is shown a detailed illustration of the spinwheel assembly and its associated blade and cam sub-assemblies. More specifically, it is seen in FIG. 4, and the associated radial cross-sectional view of FIG. 5, that each spinwheel 10 is provided with a plurality of blades 22. Each blade is slidably held within a housing 34 and is reciprocated by virtue of the rotating motion of the spinwheel 1o with relation to an inversely shaped cam element 36. It is noted that the spinwheel 10 moves in the direction indicated by the arrow 37 at the right edge of FIG. 5. Accordingly, it may be noted that the grooves 38 serve to increase the surface area of the blade 22 which will come into contact with the surrounding water 40.

In FIG. 4, one will note that the bearing element 42 of the blade 22 is so shaped as to permit the cam 36 to be moved downward in order to disengage the blade 22 when the operator desires to place the assembly in a neutral position. In order to effectuate a reversal of direction of the craft, the cam 36 is turned so as to engage it with either of the other blades 22' or 22''. This procedure represents an advancement over those prior art systems which require a reversal in spin direction of the propeller assembly in order to achieve a reverse in direction of the vessel.

Figure 4A:
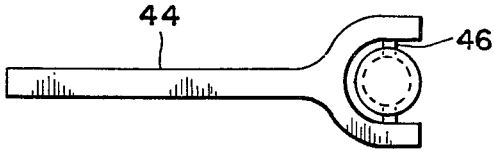
FIG. 4*a* is a top, cross-sectional view, taken along line 4*a*—4*a* of FIG. 4.

Changes in cam position are effectuated through the use of a lever 44 and fulcrom 46 (see FIGS. 4 and 4*a*) which are utilized in order to raise and/or turn the cam 36.

Figure 7:
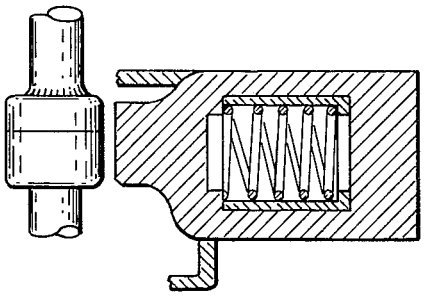
FIG. 7 is a view, similar to FIG. 6, however showing the blade in a retracted position.

A proper biasing of the blades 22 against the cam 36 is obtained through the use of a spring element 48 or the equivalent thereof. Through the use of such a spring element the extension (see FIG. 7) of the blade 22 within its housing 34 is facilitated.

Figure 8:
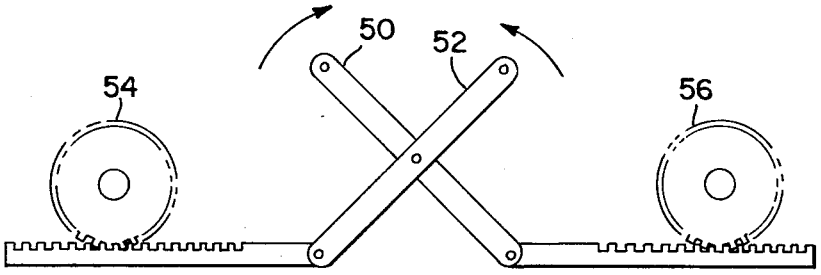
FIG. 8 is a top schematic view of the rack and pinion cam control sub-system, said view taken along line 8—8 of FIG. 1.

In FIG. 8, which is a sectional view taken along line 8-8 of FIG. 2, a scissors-like rack and pinion device, intended to effectuate a simultaneous and symmetrical change in positions of the two respective spinwheels, is shown. More particularly, by pressing the two handles 50 and 52 toward each other, the respective cam control elements 54 and 56 are rotated in opposite directions, thereby effectuating the desired change in forward or reverse cam and blade positions.

It is to be noted that the present above-described blade sub-system, which facilitates the alternate extension and retraction of said blades, acts to eliminate water drag within the areas 38 and 60 shown within FIG. 3. That is, in the absence of the above described cam function, the blades 22 would otherwise experience substantial water drag as they traverse the inner areas 38 and 60 of the shrouds 18 and 20 of the respective spinwheels 10 and 12.

It is thus seen that the objects enumerated in the Summary of the Invention have been efficiently attained by the above described embodiments of the present invention.

While there have been herein shown and described the preferred embodiments of the present invention, it will be understood that the invention may be embodied otherwise than as herein specifically illustrated or described and that within said embodiments certain changes in the detail and construction, and the form and arrangement of the parts may be made without departing from the underlying idea or principles of this invention within the scope of the appended claims.

Having thus described my invention what I claim as new, useful and non-obvious and, accordingly, secure by Letters Patent of the United States is:

1. A counter-rotating marine propulsion system comprising:

a. two-symmetrical spinwheel assemblies, said assemblies horizontally disposed with respect to the bottom of a boat and actuated by a mechanical power supply means;

b. a cam axially disposed within each of said spinwheels; and c. a plurality of drive blades disposed in reciprocating relationship to said cam such that the extension and retraction of said blades can be controlled through selective transmissional changes in an otherwise fixed position of said cam and further in which said spinwheel will rotate about the same axis upon which said cam is secured, thereby causing the selective extension of said blades in response to the motion of said spinwheel past a particular bearing surface of said cam.

2. The system as recited in claim 1 in which said system further comprises a pair of shrouds and deflectors in which each of said spinwheel assemblies is partially surrounded by one pair of said shrouds and deflectors, the purpose of said shrouds and deflectors being both to encase and protect the spinwheels and to direct the displacement of water in a direction parallel to the keel of the boat, thereby maximizing the efficiency of the present system.

3. The system as recited in claim 2 in which said shrouds are rotatably movable with respect to said spinwheel assembly, thereby constituting a means of direction control for the present system.

4. The system as recited in claim 1 in which said cam comprises an inverse cam having its greatest bearing surface displaced radially away from the axis of rotation of said cam.

5. The system as recited in claim 4 in which said blades are provided with one concave surface, said surface being that surface which is opposite to the direction of motion of the craft.

6. The system as recited in claim 1 in which the engagement and disengagement of said cam with respect to said blades is changed by means of a clutch.

7. The system as recited in claim 6 in which said clutch constitutes a fulcrum and lever combination permitting the axially movement upward and downward of said cam so as to bring it selectively out and into engagement with the bearing surfaces of said blades.

8. The system as recited in claim 7 in which a change in drive selection position of said cam is executed by use of a means for continuously engaged rotation of said cam.

9. The system as recited in claim 1 in which both spinwheels are powered by a single engine.

10. The system as recited in claim 1 in which each spinwheel is individually powered by a separate engine, each of said engines having a synchronous speed.

* * * * *